United States Patent [19]

Psaar

[11] Patent Number: 4,600,930

[45] Date of Patent: Jul. 15, 1986

[54] RECORDING MATERIAL WHICH REACTS UNDER THE INFLUENCE OF HEAT, ITS PREPARATION AND THE USE OF ACID-MODIFIED POLYMERS AS ACCEPTORS IN THIS RECORDING MATERIAL

[75] Inventor: Hubertus Psaar, Leverkusen, Fed. Rep. of Germany

[73] Assignee: Bayer Aktiengesellschaft, Leverkusen, Fed. Rep. of Germany

[21] Appl. No.: 658,341

[22] Filed: Oct. 5, 1984

[30] Foreign Application Priority Data

Oct. 13, 1983 [DE] Fed. Rep. of Germany ..... 3337296

[51] Int. Cl.[4] ..... B41M 5/18

[52] U.S. Cl. ..... 346/201; 346/209; 346/216; 346/217; 346/224; 346/225; 427/150; 427/151

[58] Field of Search ..... 346/209, 216, 225, 201, 346/217, 218, 221, 224; 427/150–152

[56] References Cited

U.S. PATENT DOCUMENTS 3,874,895 4/1975 Hayashi et al. ..... 346/216

*Primary Examiner*—Bruce H. Hess

*Attorney, Agent, or Firm*—Sprung Horn Kramer & Woods

[57] ABSTRACT

The recording material which reacts under the influence of heat contains an acid-modified polymer of acrylonitrile as an acceptor, in addition to a dyestuff precursor.

10 Claims, No Drawings

RECORDING MATERIAL WHICH REACTS UNDER THE INFLUENCE OF HEAT, ITS PREPARATION AND THE USE OF ACID-MODIFIED POLYMERS AS ACCEPTORS IN THIS RECORDING MATERIAL

The invention relates to a recording material which reacts under the influence of heat and contains a dyestuff precursor and an acid-modified polymer of acrylonitrile as an acceptor.

Heat-sensitive recording materials in which a colourless dyestuff precursor and an acceptor are applied in one layer to a carrier material, the two components being coated separately with other materials in order to prevent a premature colour reaction, are already known. On treatment with heat, the two components are brought into contact by melting of the coatings and, if appropriate, of the acceptor materials and a colour reaction is triggered off. Dyestuff precursors from various classes of dyestuffs are known as the colour-forming agents. Organic compounds containing phenolic groups, for example bisphenol A, have hitherto chiefly been disclosed as materials which can trigger off the colour reaction, but because of their high rate of migration and volatility, these have to be mixed with absorbents, such as kaolin. The volatility of the phenols is a great disadvantage of these materials, since odour nuisances frequently occur. Another disadvantage of these acceptors is their sensitivity to pressure. Colour reactions can already be triggered off by increased pressure on the materials. In addition, the influence of moisture can lead to the disappearance of the recorded image. Various other acceptors, such as acid, metal salts or compounds which split off acid, have also been described, but these all have the disadvantage that the dyestuffs formed usually have only an inadequate stability to light on them.

It has now been found that acid-modified polyacrylonitrile, such as is used for the production of fibres, is an acceptor material which does not have the abovementioned disadvantages. Besides polymers of acrylonitrile, it is also possible to use copolymers of acrylonitrile with other vinyl compounds, such as vinylidene cyanide, vinyl fluoride, vinyl acetate, vinyl propionate, vinylpyridine, vinylimidazole, vinylpyrrolidone, vinylethanol, acrylic or methacrylic acid esters and hydroxyalkyl esters and acrylic or methacrylic acid amides and dialkylamides, these copolymers containing at least 50% by weight, preferably at least 85% by weight, of acrylonitrile units. The polymers preferably contain a sulpho or sulphato group as the acid group. The glass transition temperatures of the polymers can be varied within wide ranges and adjusted to the desired effect by using particular comonomers. Comonomers which are preferably suitable for this purpose are acrylates, such as methyl, ethyl, n-propyl, n-, iso- or tert.-butyl, hexyl, 2-ethylhexyl and lauryl acrylates. The acid-modified acrylonitrile polymers are prepared by known methods, the acid group being either introduced into the end of the polymerisation chain by an acid catalyst or copolymerised by means of comonomers containing acid groups, for example vinylsulphonic acid, styrenesulphonic acid, allylsulphonic acid, methallylsulphonic acid, vinyloxyarenesulphonic acid, allyloxyarenesulphonic acid, methallyloxyarenesulphonic acid or acryloxyalkoxyarenesulphonic acid. These preparations are described, for example, in German Pat. No. C-654,989, U.S. Pat. No. A-2,601,256 and U.S. Pat. No. 2,913,438, and in F. Krczil "Kurzes Handbuch der Polymerisationstechnik" ("Short Handbook of Polymerisation technique") (1940) Volume I, pages 722–725, and in Houben-Weyl, "Methoden der organischen Chemie" ("Methods of Organic Chemistry") (1961), Volume XIV/1 pages 998 to 1009.

In principle, all acrylic polymers which contain acid groups capable of developing the dyestuff precursors are suitable. The content of acid groups in the acrylic polymer is preferably 0.5 to 2% by weight.

Suitable dyestuff precursors are the dyestuff-forming agents which can usually be employed for the purpose of copying by means of pressure or heat, with the exception of those which can be converted into dyestuffs only by atmospheric oxidation. Suitable colour-forming agents are described, for example, in the following publications: U.S. Pat. No. 3,193,404, U.S. Pat. No. 3,489,800, German Pat. No. A-2,001,864, German Pat. No. A-2,363,453, British Pat. No. A-1,160,940, Japanese Pat. No. A-53,9127, Japanese Pat. No. A-46,29550, Japanese Pat. No. A-43,2119, Japanese Pat. No. A-52,148 099, Japanese Pat. No. A-48,3695, Japanese Pat. No. A-51,23204 and Japanese Pat. No. A-56,52729.

Carbinol bases or derivatives thereof, in particular carbinol bases or carbinol base ethers with small dyestuff molecules which, because of their low molecular weight, can easily penetrate into the polymers and can be bonded there in salt form, are particularly suitable.

Examples of such compounds are carbinol bases and carbinol base derivatives of diaryl- and triarylmethane dyestuffs, which are described, for example, in U.S. Pat. No. 4,211,436 and fluoranes.

To prepare the heat-sensitive materials, for example paper, the acid-modified acrylonitrile polymers are ground, in powder form, with binders, for example polyvinyl alcohol, hydroxyethylcellulose, gum arabic, polyvinylpyrrolidone, casein or similar substances.

For better formation of the dyestuff, it is advantageous to add to the polymers fatty acids or fatty acid amides, long-chain alkyl-sulphates or esters of long-chain alcohols, for example phosphoric acid esters of long-chain alcohols, such as mono- and di-phosphates of $C_8$- to $C_{22}$-alcohols, in amounts of 0.1 to 10%, based on the polymer. The polymer can also be pretreated with the additives, for example ground. The colouring agents are ground separately from the binders. The dispersions of the acceptor are mixed with the dispersions of the colouring agent and applied to the carrier material, preferably cellulose paper, by means of a doctor blade and dried such that a coating weight of 5 to 8 g per $m^2$ results. Depending on the reactivity of the colouring agent, it is also possible to grind the polymer and colouring agent together with the binder and to apply the mixture as described. Furthermore, bases, for example aliphatic amines or carbonates, for example whiting, can be added to stabilise the colour-forming agents.

In another procedure, it is also possible to produce the acceptor paper in a sheet-forming machine from a mixture of an acrylonitrile polymer with the additives described above and pulp, sizing agent and aluminium sulphate and to coat the paper with the colour-forming agent.

EXAMPLE 1

40 g of a finely powdered polyacrylonitrile polymer prepared from 94% of acrylonitrile, 0.5% of methallylsulphonic acid and 5.5% of methyl acrylate, are ground with 225 g of 8% strength aqueous polyvinyl alcohol solution, with the addition of 1.3 g of distearyl phosphate, in a ball mill. A second dispersion is prepared from 1 g of octyl 4,4'-bis-(dimethylamino)-benzhydryl sulphone and 55 g of 8% strength aqueous polyvinyl alcohol solution. The dispersion of the colour-forming agent is mixed with that of the acceptor in a ratio of 1/10 and the mixture is applied to cellulose paper by means of a doctor blade and dried such that a coating rate of 6 to 7 g/m$^2$ is obtained. The paper can be written on with writing implements, such as, for example, a ball-point pen. It is insensitive to heavy pressure. When the paper is touched with a heated pen, clear, sharp, shadow-free, blue writing is obtained. The dyeing has excellent fastness to light.

Instead of the above-mentioned colour-forming agent it is also possible to use the following colour-forming agents: phenyl-4,4'-bis-(dimethylamino)-benzhydryl sulphone, phenyl-4,4'-bis-(dimethylamino)-benzhydrylsulphonamide, p-tolyl-4,4'-bis-(dimethylamino)-benzhydryl sulphonamide, p-tolyl-3,3'-bismethyl-4,4'-bis-(dimethylamino)-benzhydryl sulphone, p-tolyl-4,4'-bis-(diethylamino)-benzhydryl sulphone, dodecyl-4,4'-bis-(dimethylamino)-benzhydryl sulphone, p-dodecyl-phenyl-4,4'-bis(dimethylamino)-benzhydryl sulphone.

Blue writing which is fast to light is also obtained when touching the paper, thus treated, with a heated pen.

EXAMPLE 2

40 g of a polyacrylic polymer prepared from 86.5% of acrylonitrile, 0.5% of methallylsulphonic acid and 13% of methylacrylate are ground with 1.3 g of monostearyl phosphate and 425 g of water and the polymer is filtered off with suction and dried. The dry polymer is ground with 112 g of 4% strength aqueous polyvinyl alcohol solution. A second dispersion is prepared from 2 g of a colour-forming agent of the formula

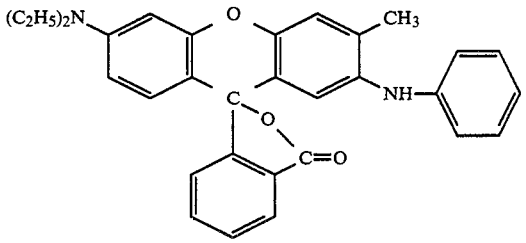

and 55 g of 8% strength aqueous polyvinyl alcohol solution. The two dispersions are mixed in the ratio of 1/10 according to Example 1 and the mixture is applied to cellulose paper. Black writing which is fast to light is obtained on the dried sheet of paper using a heated pen.

If a compound of the formula

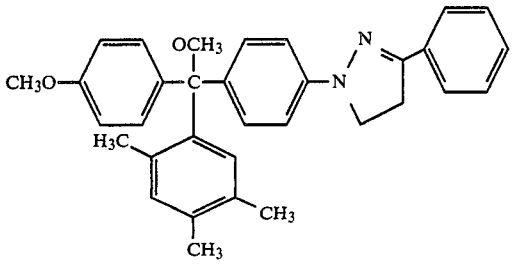

(Example 2 of U.S. Pat. No. 4,211,436) is used instead of the abovementioned colour-forming agent, black-blue writing which is fast to light is obtained on contact with a heated pen.

EXAMPLE 3

40 g of an acrylonitrile polymer prepared from 92.2% of acrylonitrile, 2% of methallylsulphonic acid and 5.8% of methyl acrylate are treated with 1.3 g of the ethanolamine salt of distearyl phosphate as in Example 2 and the mixture is dispersed in a polyvinyl alcohol solution. The dispersion is mixed with a second dispersion of 2 g of the colour-forming agent of the formula

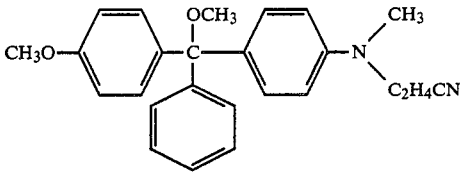

(Example 3 of U.S. Pat. No. 4,211,436) and 55 g of an aqueous 8% strength polyvinyl alcohol solution in a ratio of 1/10 and the mixture is applied to cellulose paper according to Example 1. When the paper is written on with a heated pen, red writing which is fast to light is obtained.

If the polymer is replaced by a polyacrylonitrile polymer containing 22% of methyl acrylate and the colour-forming agent is replaced by one of the formula

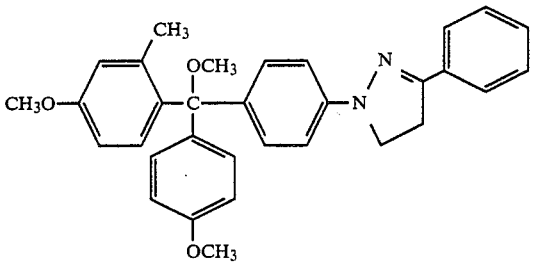

black-blue writing which is fast to light is obtained when paper is written on under the influence of heat.

If the colour-forming agent is replaced by a colour-forming agent according to the table in columns 9–16 of U.S. Pat. No. 4,211,436 writings having the colour shades given in the table are obtained when paper is written on under the influence of heat.

EXAMPLE 4

40 g of an acrylonitrile polymer of 89% of acrylonitrile, 1.9% of styrenesulphonic acid, and 9% of methyl acrylate are ground with 3 g of the ethanolamine salt of distearyl phosphate and 225 g of a 2% strength aqueous polyvinyl alcohol solution. A second dispersion is prepared from 2 g of p-tolyl-4,4'-bis-(dimethylamino)-benzhydryl sulphone and 55 g of an 8% strength aqueous polyvinyl alcohol solution. Both dispersions are mixed and the mixture is applied to paper in a ratio of 1/10 according to Example 1. Blue writing which is fast to light is obtained using a heated pen.

Blue impressions which are fast to light are also obtained when, instead of the above-mentioned polymer, acrylic polymers of the following composition are used: 80% of acrylonitrile, 4.5% of styrenesulphonic acid and 14.5% of butyl acrylate; 78.5% of acrylonitrile, 1.5% of methallylsulphonic acid and 20% of ethyl acrylate; 54% of acrylonitrile, 1% of methallylsulphonic acid and 45% of methyl acrylate; 78.5% of acrylonitrile, 14% of styrenesulphonic acid and 7% of methyl acrylate; 89.5 of acrylonitrile, 0.8% of methallylsulphonic acid and 9.5% of N-phenylmaleimide; 73% of acrylonitrile, 2.5% of 2-acrylamido-2-methylpropanesulphonic acid and 24.5% of butyl acrylate; 84% of acrylonitrile, 1.7% of 2-acrylamido-2-methylpropanesulphonic acid and 14% of ethylhexyl acrylate; and 88% of acrylonitrile, 1.8% of 2-acrylamido-2-methylpropanesulphonic acid and 13.5% of stearyl methacrylate.

I claim:

1. A recording material which reacts under the influence of heat and contains a dyestuff precursor and an acceptor material, characterised in that the acceptor material is an acid-modified polymer of acrylonitrile.

2. A recording material which reacts under the influence of heat, according to claim 1, characterised in that said polymer contains 0.5 to 2% by weight of acid groups.

3. A recording material which reacts under the influence of heat, according to claim 1, characterised in that the polymer contains at least 50% by weight of acrylonitrile units and contains, as the acid group, a sulpho or sulphato group.

4. A recording material which reacts under the influence of heat, according to claim 1, characterised in that the acrylonitrile polymer contains acrylate or methacrylate as a further comonomer.

5. A recording material which reacts under the influence of heat, according to claim 1, characterised in that it contains carbinol bases or carbinol base derivatives of di- or tri-arylmethane dyestuffs or fluoranes as the dyestuff precursors.

6. A recording material which reacts under the influence of heat, according to claim 1, characterised in that it contains 4,4'-tetraalkyl-diaminodiarylmethanealkylsulphinates as the dyestuff precursors.

7. A recording material which reacts under the influence of heat, according to claim 1, characterised in that the material contains phosphoric acid esters of long-chain alcohols.

8. A recording material which reacts under the influence of heat, according to claim 7, characterised in that the material preferably contains mono- or diphosphoric acid esters of $C_8$ to $C_{22}$-alcohols.

9. Process for the preparation of the recording material of claim 1, which reacts under the influence of heat, by coating carrier materials with formulations containing dyestuff precursors and acceptors.

10. Use of acid-modified polymers of acrylonitrile as acceptors in recording materials which react under the influence of heat.

* * * * *

UNITED STATES PATENT AND TRADEMARK OFFICE

CERTIFICATE OF CORRECTION

PATENT NO. : 4,600,930

DATED : July 15, 1986

INVENTOR(S) : Hubertus Psaar

It is certified that error appears in the above-identified patent and that said Letters Patent are hereby corrected as shown below:

Col. 6, line 33-35 Delete claim "10" in its entirety

On the title page, "10 Claims" should read -- 9 Claims --.

Signed and Sealed this

Ninth Day of December, 1986

*Attest:*

DONALD J. QUIGG

*Attesting Officer* *Commissioner of Patents and Trademarks*